US005712444A

United States Patent [19]

Brion et al.

[11] Patent Number: 5,712,444

[45] Date of Patent: Jan. 27, 1998

[54] PRIMING MECHANISM FOR A PROPELLANT CHARGE NOTABLY FOR FIELD ARTILLERY AMMUNITION AND ITS MANUFACTURING PROCESS

[75] Inventors: Bernard Brion, Bourges; Claude Julien, Vasselay, both of France

[73] Assignee: Giat Industries, Versailles, France

[21] Appl. No.: 678,679

[22] Filed: Jul. 11, 1996

[30] Foreign Application Priority Data

Jul. 20, 1995 [FR] France ..... 95 08812

[51] Int. Cl.[6] ..... F42C 19/085

[52] U.S. Cl. ..... 102/202; 102/282; 102/283; 102/380; 102/431; 102/470; 86/1.1; 60/256

[58] Field of Search ..... 102/202, 204, 102/205, 275.1, 275.6, 275.8, 282, 283, 285, 286, 287, 288, 380, 431, 432, 433, 470, 700; 86/1.1, 10; 60/256

[56] References Cited

U.S. PATENT DOCUMENTS

| | | | |
|---|---|---|---|
| 3,151,447 | 10/1964 | Bornstein | 102/202 |
| 4,002,122 | 1/1977 | Gould | 102/202 |
| 4,702,167 | 10/1987 | Reinelt et al. | 102/282 |
| 4,922,823 | 5/1990 | Rahnenfuhrer | 102/288 |
| 5,069,130 | 12/1991 | Buckley et al. | 102/202 |
| 5,269,224 | 12/1993 | Gonzales et al. | 102/288 |

FOREIGN PATENT DOCUMENTS

| | | | |
|---|---|---|---|
| A-0 475 207 | 3/1992 | European Pat. Off. . | |
| A-0 499 244 | 8/1992 | European Pat. Off. . | |
| A-2 590 360 | 5/1987 | France . | |
| 5026600 | 2/1993 | Japan | 102/283 |
| 5105572 | 4/1993 | Japan | 102/282 |
| 5118793 | 5/1993 | Japan | 102/282 |
| 2160625 | 12/1985 | United Kingdom | 102/202 |
| WO 86/01584 | 3/1986 | WIPO . | |

*Primary Examiner*—Harold J. Tudor
*Attorney, Agent, or Firm*—Oliff & Berridge, P.L.C.

[57] ABSTRACT

A priming mechanism for a propellant charge, notably for field artillery ammunition, comprising a tube (2) made of a combustible material, whose inner wall is lined with a priming charge which marks out a central channel (5) inside the tube (2), characterised in that the priming charge is formed of several successive layers (3) of black powder granules with a binder (4).

7 Claims, 2 Drawing Sheets

Figure 1:
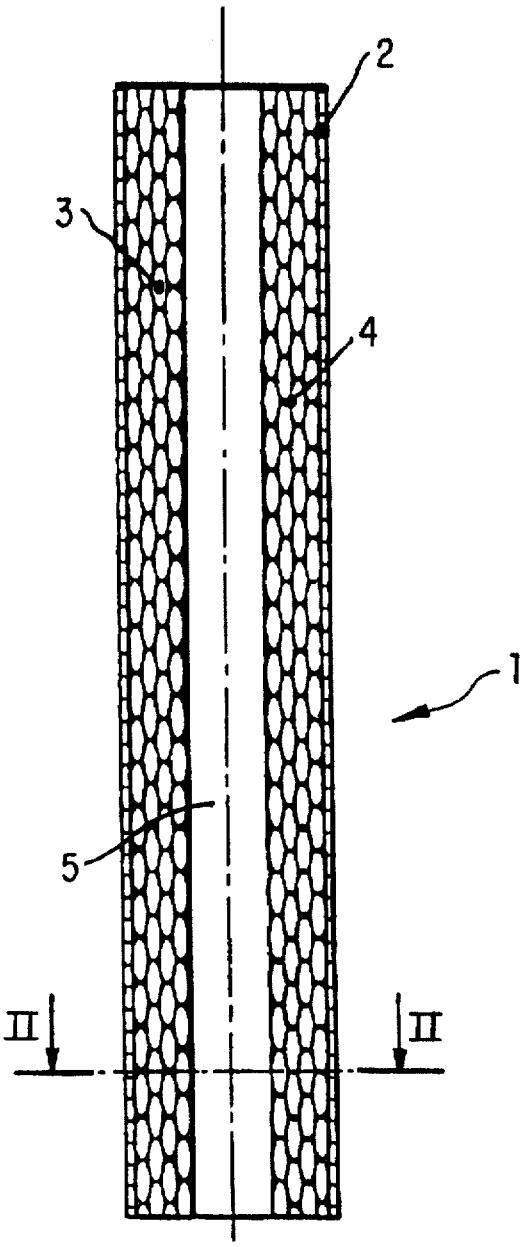

PRIMING MECHANISM FOR A PROPELLANT CHARGE NOTABLY FOR FIELD ARTILLERY AMMUNITION AND ITS MANUFACTURING PROCESS

The invention relates to a priming mechanism for a propellant charge, notably for field artillery ammunition, comprising a tube made of a combustible material, whose inner wall is lined with a priming charge which marks out a central channel inside the tube.

The propellant charge of field artillery ammunition is generally formed of a stack of combustible containers enclosing said charge which is ignited by a means to transmit a flame constituted by the afore-mentioned priming charge. Each container must therefore be fitted with a very fast priming mechanism between the priming charge and the propellant charge.

Priming mechanisms for propellant charges are notably disclosed in documents WO-8601584 and EP-A-475 207.

In document WO-8601584, the charge is formed of ring-shaped pellets assembled or stacked in a tube. Each pellet is made by compression, which obliges the use of a powder (boron/potassium nitrate powder) which has a fine granule size so as to obtain proper cohesion and strength. However, it is known that the inflammation of a powder propagates all the more quickly in that the latter is not very compacted, on the one hand, and on the other in that fine granule size generates the formation of a substantial amount of gas which prejudices priming quality. The transmission speed of priming using such pellets is thus relatively low and, consequently, not effective enough. By fine granule size, we mean granule size of between 0.1 and 0.5 mm, and a low transmission speed of around a few milliseconds.

Moreover, the density of these pellets is relatively great, such that braces made of a combustible material are required to be used between each pellet so as to respect a ratio of functional mass between the priming charge and the propellant charge.

In document EP-A-475 207, the priming mechanism comprises a compressed charge formed of powder granules mixed with a solvent, such as butylacetate. The mixture is then compressed to obtain a tubular element which is then introduced into a central hole in the propellant charge and held in place by friction or bonding. This mechanism has the drawbacks inherent to compressed charges as previously stated, since a powder necessarily of fine granule size obtained by compression is implemented.

The aim of the invention is to design a priming mechanism which is simple to manufacture and low in cost whilst having a high transmission speed and substantial inflammation capacity to meet the inadequacies of prior art.

To this end, the invention proposes a priming mechanism for a propellant charge, comprising a tube made of a combustible material, whose inner wall is lined with a priming charge which marks out a central channel inside the tube, and which is characterised in that the priming charge is formed of several successive layers of black powder granules with a binder.

Generally speaking, the black powder has a granule size of between 1 and 2.8 mm, and the binder is formed of collodion.

According to a preferred embodiment of the invention, a thin layer of binder is inserted between two layers of black powder granules.

The priming mechanism tube is advantageously formed of a material such as nitrocellulose loaded cardboard.

A further subject of the invention is the process to manufacture such a priming mechanism, a process which consists in:

a) subjecting the tube to a reduced rotational speed, of around 100 revs/minute, b) lining the inner wall of the tube with a layer of binder, such as collodion, by means of a measuring spray gun, c) spreading a layer of black powder onto the layer of collodion, by means of a feeding drip, d) successively repeating steps b and c until a priming charge of a pre-determined thickness is obtained, and e) allowing the layers to dry.

According to a first advantage of the invention, the priming system is obtained avoiding any compression of the powder, which by the same token makes it easy to manufacture and at a cost which is much lower than that of previous methods.

Another advantage of the invention lies in the facility with which the thickness of the charge can be adjusted.

Figure 2:
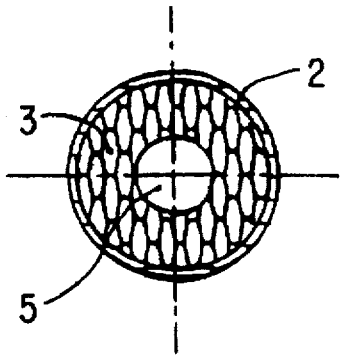
Figure 3:
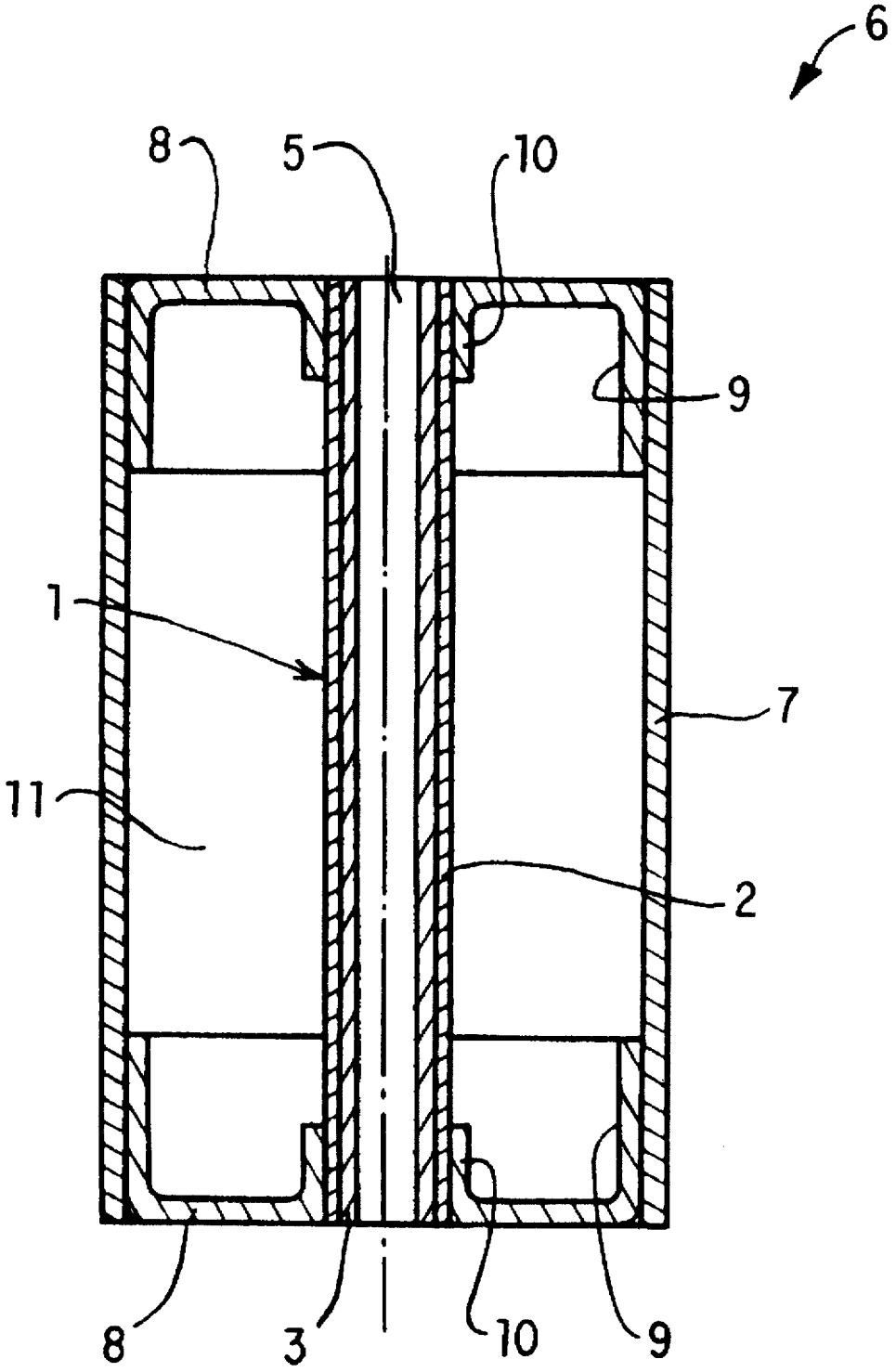

Other advantages, characteristics and particulars of the invention will become apparent from reading the explanatory description which follows, made in reference to the appended drawings, given merely by way of illustration and in which:

FIG. 1 is a longitudinal section view of a priming mechanism according to the invention, FIG. 2 is a section view along line II-II in FIG. 1, and FIG. 3 is a longitudinal section view of a container fitted with a priming system according to the invention.

The priming system illustrated in FIGS. 1 and 2 comprises a tube 2 whose inner wall is lined with a priming charge formed of several layers 3 of black powder granules with a binder 4. The innermost layer 3 demarcates a central channel 5 to enable a priming flame to pass through intended to ensure the fast ignition of the priming charge which then transmits this flame to the propellant charge.

The tube 2 is made of a combustible material, such as cardboard reinforced with nitrocellulose, to obtain full combustion.

In the embodiment illustrated in FIG. 1, there are four layers 3 of black powder, this number being fully suited to field artillery ammunition. The granule size of the black powder granules is between 1 and 2.8 mm, given that powder granules which are too large cause bonding difficulties and powder granules which are too fine do not generate enough energy.

The binder 4 is, for example, formed of collodion (a mixture of nitrocellulose and acetone) which is applied in thin layers. In concrete terms, the black powder granules are to be spread evenly, as is clearly shown in FIG. 1.

The manufacturing process for such a priming mechanism 1 is quite simple. The tube 2 is mounted on a means enabling it to be rotated at a moderate speed, around 100 revs per minute, the tube being supported by at least one of its ends or by part of its outer wall. The inner wall of the tube 2 is lined with a thin layer of collodion by means of a volumetric measuring spray gun, whose output can easily be adjusted, this gun having a translational movement inside the tube 2. A feeding drip is then inserted into the tube 2 to spread to first layer 3 of black powder granules, said granules being bound immediately. Layers of binder and then of black powder are then applied one after the other until a priming charge is obtained which is of a predetermined thickness. Finally, the assembly is dried off.

In a preferred manner, the tube 2 made of combustible cardboard is wound around in a spiral, this enables the tube to be cut away following this spiral when the black powder is ignited thus improving the distribution of the instantaneous priming of the propellant charge.

The priming mechanism previously described is particularly intended to equip a combustible container 6 such as that shown in FIG. 3. This container 6 is, for example, formed of a tubular case 7 made of a combustible material, such as, for example, nitrocellulose reinforced cardboard.

The case 7 is closed off at each end by a cover 8 also made of a combustible material. Each cover 8 is formed of a ring-shaped bottom wall 8 bordered inside and outside by two side walls which extend on the same side of the bottom wall 8 to form, respectively, two circular outer 9 and inner 10 rims. These two rims 9 and 10 enable a tight fit to be obtained between the case 7 and the tube 5 of the priming mechanism 1, this assembly possibly being finished off by bonding.

The inner volume 11 of the container 6 is filled with a propellant charge which can be either loose or in bundle form.

We claim:

1. A priming mechanism for a propellant charge, comprising a tube (2) made of a combustible material, whose inner wall is lined with a priming charge which marks out a central channel (5) inside the tube (2), characterised in that the priming charge is formed of several successive layers (3) of black powder granules with a binder (4).

2. A priming mechanism according to claim 1, characterised in that the black powder has a sieved granule size of between 1 and 2.8 mm.

3. A priming mechanism according to claim 1, characterised in that the binder (4) is formed of collodion.

4. A priming mechanism according to claim 1, characterised in that a layer of binder (4) is inserted between two layers (3) of black powder granules.

5. A priming mechanism according to claim 1 characterised in that the tube (2) is formed of nitrocellulose loaded cardboard.

6. A process to manufacture a priming mechanism as defined according to claim 1, characterised in that it consists in:

a) subjecting the tube (2) to a reduced rotational speed, of around 100 revs. per minute, b) coating the inner wall of the tube with a layer of binder (4), by means of a measuring spray gun, c) spreading a layer (3) of black powder onto the layer of binder (4), d) repeating steps b and c until a priming charge of a pre-determined thickness is obtained, and e) allowing the layers (3, 4) to dry.

7. A process according to claim 6, wherein said binder is collodion.

* * * * *